US008552649B2

(12) United States Patent
Prasad

(10) Patent No.: US 8,552,649 B2
(45) Date of Patent: Oct. 8, 2013

(54) LED LAMP HEAD WITH VARIABLE BRIGHTNESS

(75) Inventor: Vasuki Prasad, Bangalore (IN)

(73) Assignee: Honeywell International Inc., Morristown, NJ (US)

( * ) Notice: Subject to any disclaimer, the term of this patent is extended or adjusted under 35 U.S.C. 154(b) by 541 days.

(21) Appl. No.: 12/820,324

(22) Filed: Jun. 22, 2010

(65) Prior Publication Data

US 2011/0309770 A1 Dec. 22, 2011

(51) Int. Cl.
*H05B 37/00* (2006.01)

(52) U.S. Cl.
USPC ..... 315/82; 315/291; 315/307

(58) Field of Classification Search
USPC ..... 315/291, 82, 76, 77, 83, 294, 307, 315/185 R, 192, 193
See application file for complete search history.

(56) References Cited

U.S. PATENT DOCUMENTS

| | | | | |
|---|---|---|---|---|
| 5,642,016 | A * | 6/1997 | Shalvi | 315/94 |
| 2002/0101171 | A1* | 8/2002 | Kao et al. | 315/169.3 |
| 2008/0084222 | A1* | 4/2008 | Yen | 324/713 |
| 2010/0084991 | A1 | 4/2010 | Liu et al. | |
| 2011/0037410 | A1* | 2/2011 | Hsu et al. | 315/294 |

* cited by examiner

*Primary Examiner* — David H Vu
(74) *Attorney, Agent, or Firm* — Shumaker & Sieffert, P.A.

(57) ABSTRACT

A lamp head is configured to be electrically coupled solely to a power-supply element and a return element. A power voltage carried by the power-supply element is regulated by a control element. The lamp includes at least one LED configured to emit light, and a first circuit coupled to the at least one LED and configured to adjust the brightness of the light emitted by the at least one LED solely in response to adjustments made to the power voltage by the control element.

18 Claims, 7 Drawing Sheets

LED LAMP HEAD WITH VARIABLE BRIGHTNESS

BACKGROUND OF THE INVENTION

As illustrated in FIG. 1, a lamp 10, such as may be present in an aircraft cockpit 20, that employs incandescent bulbs requires only two wires (i.e., those associated with a power-supply line 30 and return line 40) to provide power to the bulb. Any dimming is done at the front end by the use of a resistor (not shown) in series with the bulb. Typically, dimming of the lamp 10 is effected by a three-position switch associated with a control element, such as a switch box 50.

In replacing such incandescent bulbs with LEDs, a challenge lies in providing an exact back-end retrofit, without a change in the associated power-supply wiring, to allow for lamp dimming, and still maintain a constant current through the LED string at each brightness level.

LEDs require constant current. There is no guarantee of a constant current with a resistor alone. Using only a fixed constant-current circuit will prevent the lamp from being dimmable.

SUMMARY OF THE INVENTION

In an embodiment, a lamp head is configured to be electrically coupled solely to a power-supply element and a return element. A power voltage carried by the power-supply element is regulated by a control element. The lamp includes at least one LED configured to emit light, and a first circuit coupled to the at least one LED and configured to adjust the brightness of the light emitted by the at least one LED solely in response to adjustments made to the power voltage by the control element.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
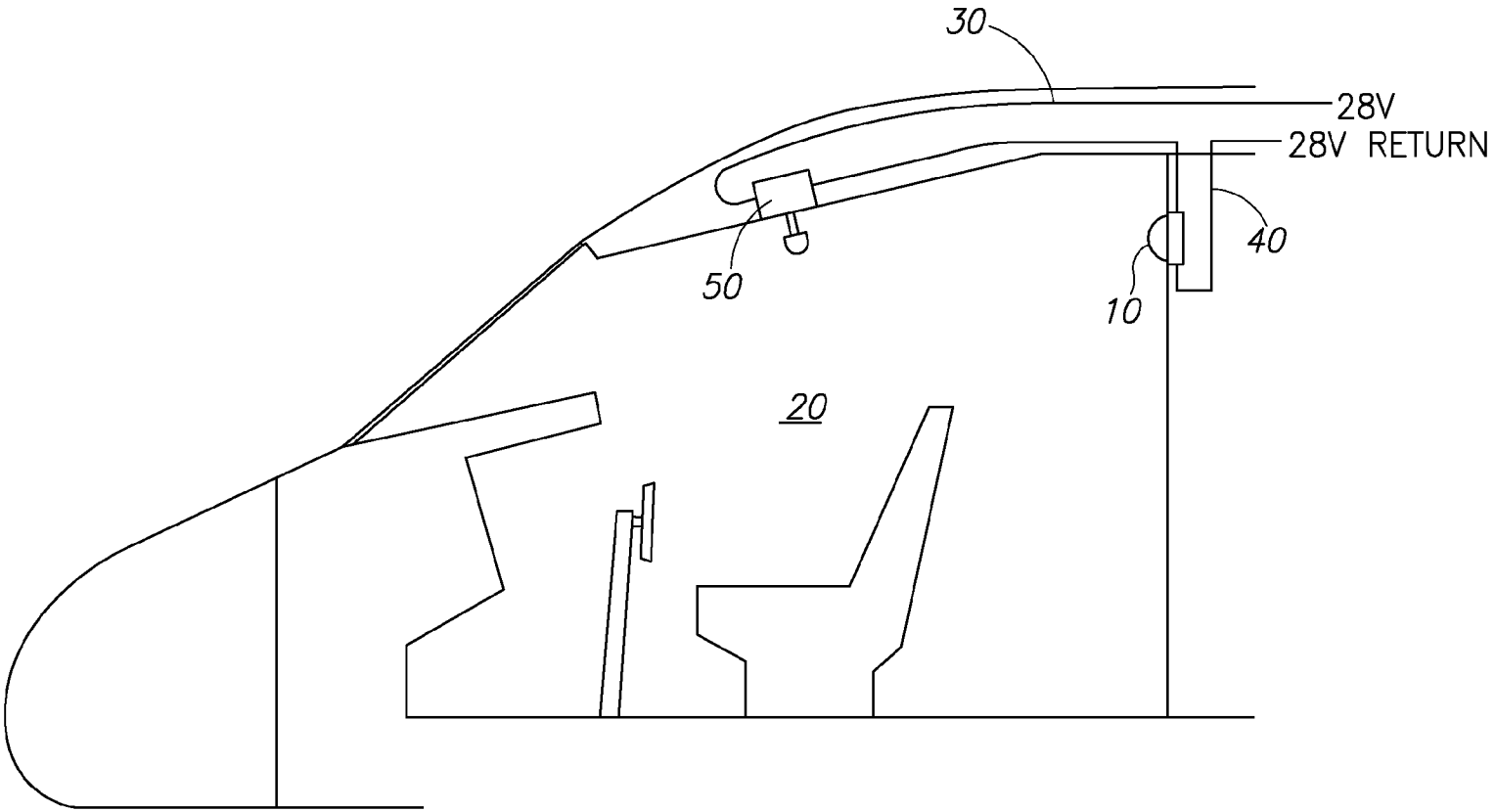
FIG. 1 (PRIOR ART)
FIG. 1 illustrates an aircraft cockpit in which embodiments of the present invention may be implemented.
Figure 2:
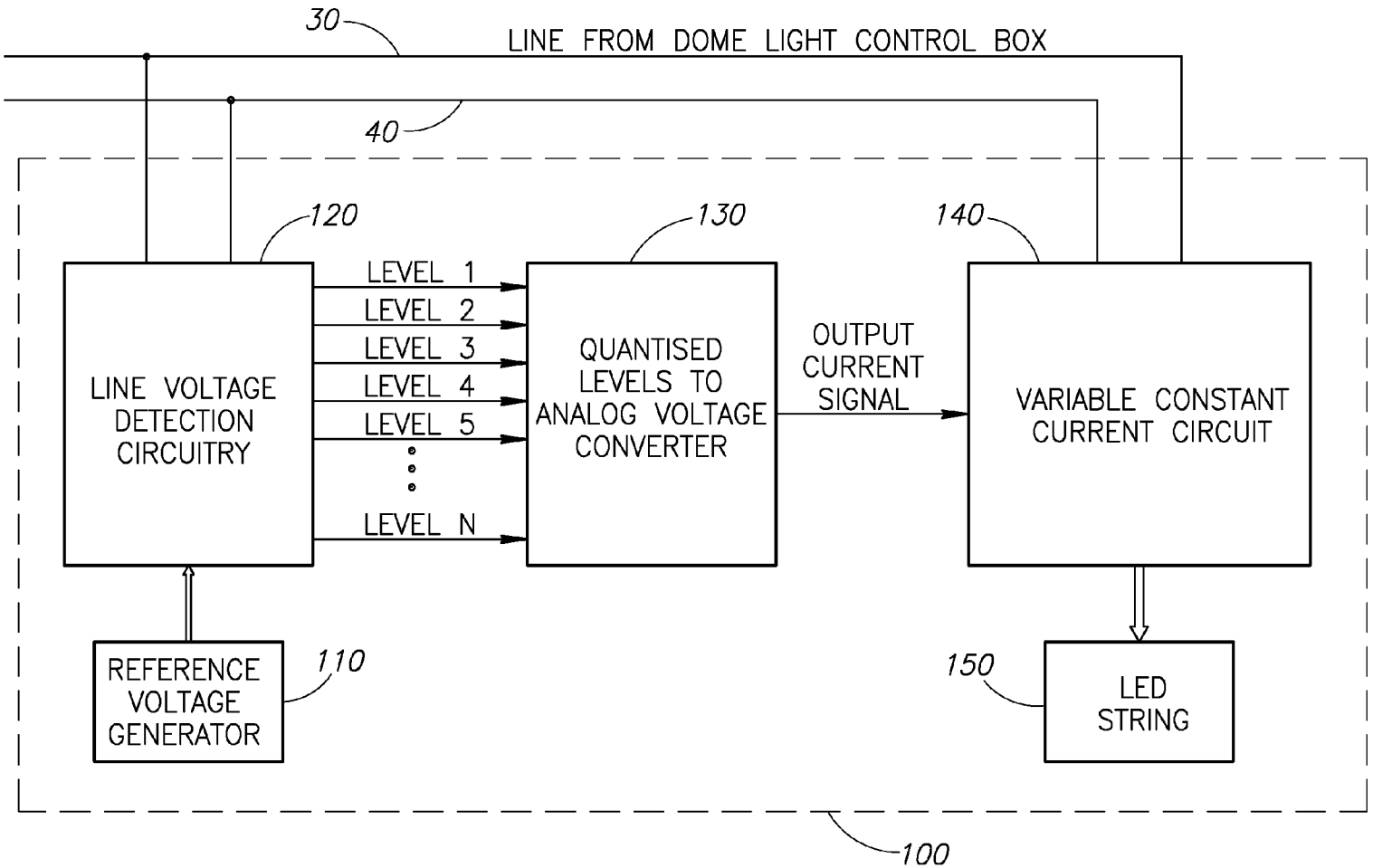
FIG. 2 is a functional block diagram illustrating elements of a lamp head according to an embodiment of the invention.

FIG. 2 is a functional block diagram illustrating elements of a lamp head 100, as indicated by a dashed line, according to an embodiment of the invention. Where elements illustrated in FIG. 1 may be employed for purposes of describing the embodiment illustrated in FIG. 2, like elements are indicated by like reference numerals. An exemplary, and non-limiting, circuit diagram illustrating a manner in which the elements of FIG. 2 can be implemented is illustrated in FIG. 3.

The only electrical/communication lines coupled to the lamp head 100 are the power-supply line 30 and return line 40. The lamp head 100 includes a reference-voltage generator 110, line-voltage detection circuitry 120, converter circuitry 130, a variable constant-current circuit 140, and an LED string 150, which is configured to emit light. As will be discussed in greater detail herein, the elements 110-140 are configured to adjust the brightness of the light emitted by the at least one LED solely in response to adjustments by a control element, such as switch box 50, made to the power voltage carried by power-supply line 30.

Figure 3:
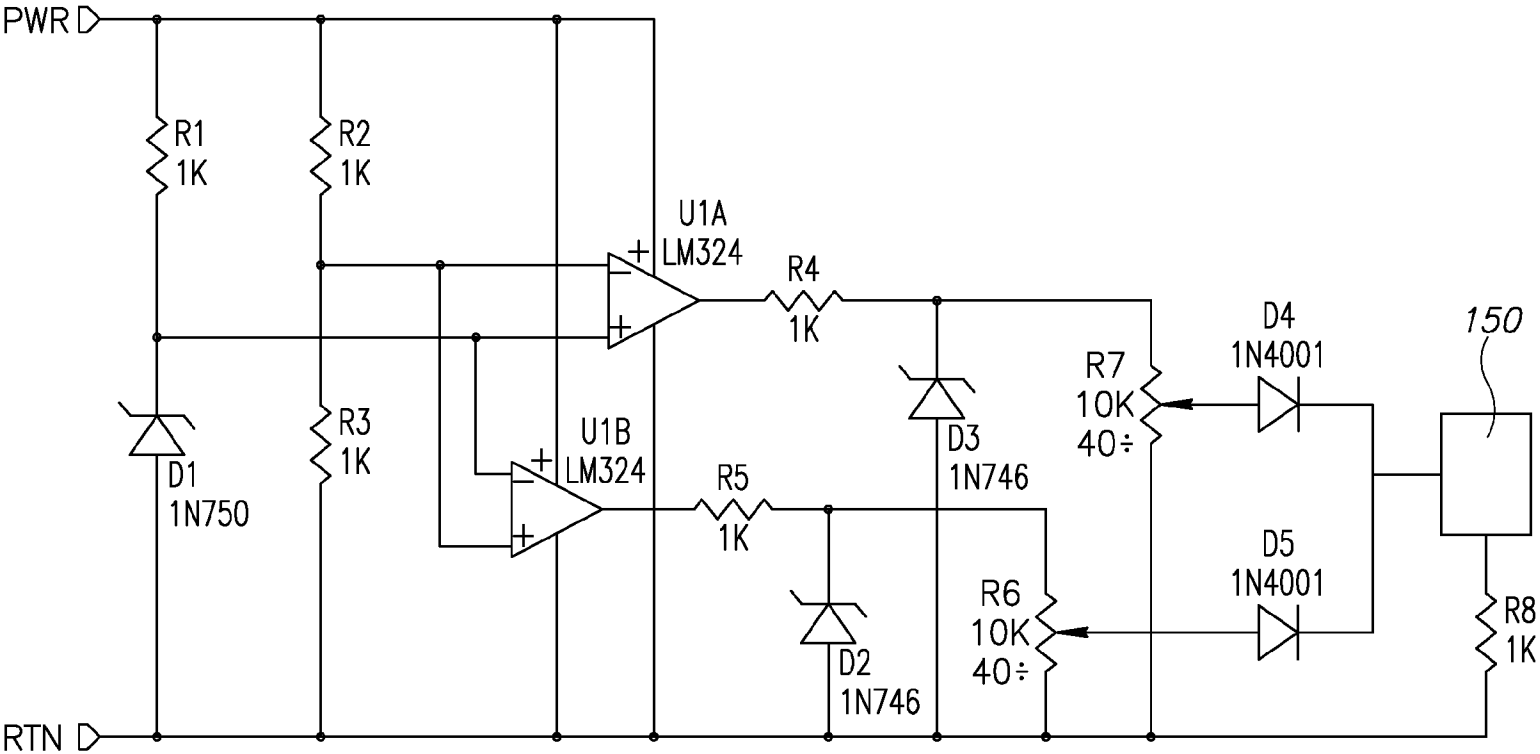
FIG. 3 is an exemplary circuit diagram illustrating a manner in which the elements of FIG. 2 can be implemented.

As can be seen in FIG. 3, the generator 110 may include a resistive element, such as resistor R1, and a rectifying element, such as zener diode D1. In an embodiment, the generator 110 is coupled to power-supply line 30 and return line 40, and provides a 5-volt (or any other appropriate fixed-voltage value) first reference voltage (that may be labeled herein as $V_{REF}$), which remains constant, irrespective of the level of power voltage carried by power-supply line 30.

Figure 4:
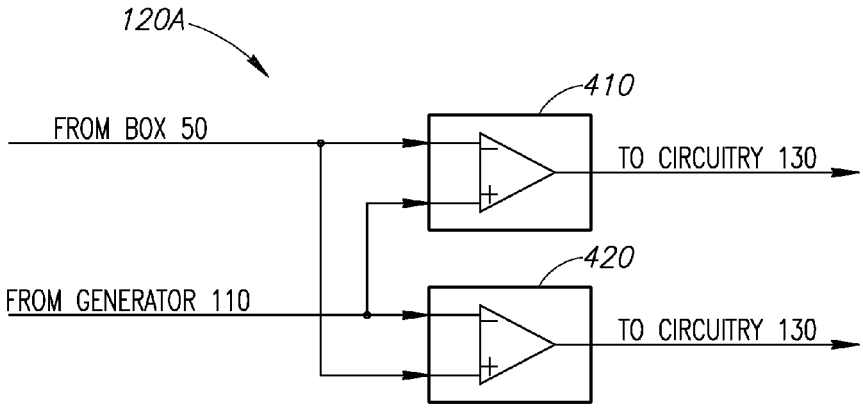
FIG. 4 illustrates line-voltage detection circuitry according to an analog approach of an embodiment of the invention.

FIG. 4 illustrates line-voltage detection circuitry 120*a* according to an analog approach of an embodiment of the invention. The circuitry 120*a* is configured to determine a difference between the reference voltage produced by generator 110 and the power voltage, which may be a scaled-down voltage level relative to the voltage level generated by the power source, carried by power-supply line 30 and generate a signal based on the determined difference. The line-voltage detection circuitry 120*a* of the embodiment illustrated in FIG. 4 includes first and second operational amplifiers 410, 420, which are equivalent to OPAMPS U1A and U1B illustrated in FIG. 3. Referring again to FIG. 3, R2 and R3 together form a voltage divider, with an output proportional to the power voltage carried by power-supply line 30. Operational amplifiers 410, 420 may be either run off power voltage carried by power-supply line 30, directly, or through a voltage regulator for predictability. The operational amplifiers 410, 420 serve as comparators, with mutually exclusive outputs for two cases: When reference voltage produced by generator 110 is less than power voltage carried by power-supply line 30, operational amplifier 420 is triggered, corresponding to a BRIGHT selection using the box 50. When reference voltage produced by generator 110 is greater than the power voltage carried by power-supply line 30, operational amplifier 410 is triggered, corresponding to a DIM selection using the box 50.

In an alternative embodiment, multiple dimming intensities may be realized by the use of a corresponding multiple of window comparators, similar to operational amplifiers 410, 420, for various line voltage levels. Another alternative embodiment may provide continuous analog dimming by the use of the resistive voltage divider, directly, with current limited by an OPAMP so as to not exceed the maximum permissible current through the LED string 150.

Figure 5:
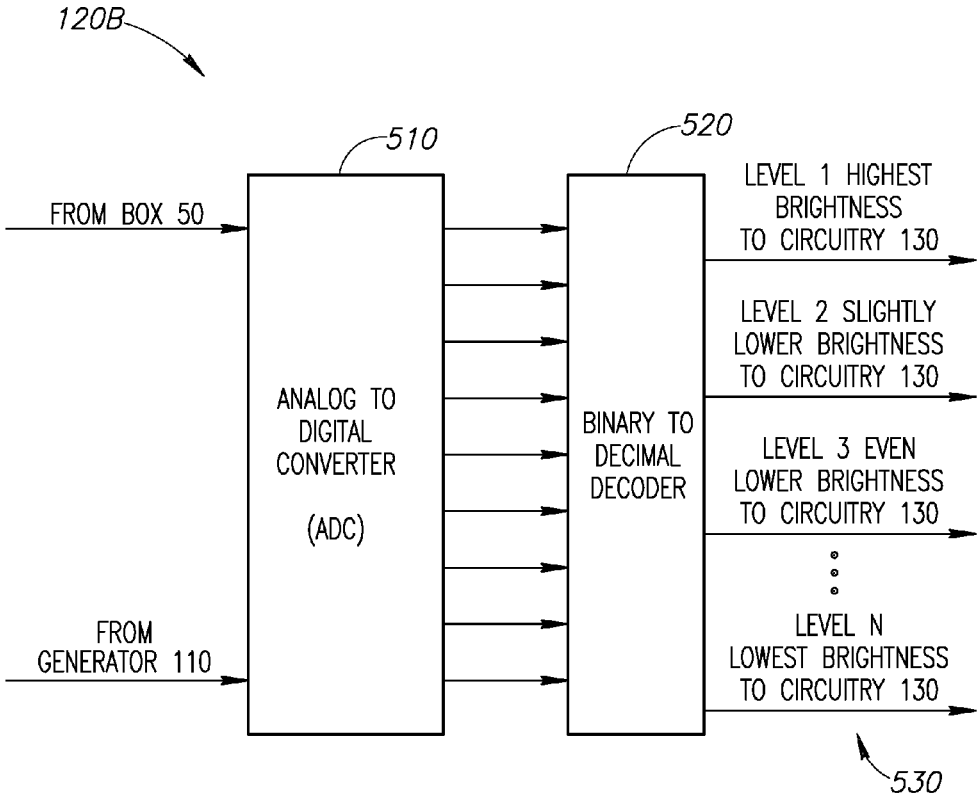
FIG. 5 illustrates line-voltage detection circuitry according to a digital approach of an alternative embodiment of the invention.

FIG. 5 illustrates line-voltage detection circuitry 120*b* according to a digital approach of an alternative embodiment of the invention. The illustrated second embodiment may be implemented in situations where multiple levels of dimming may be desired. The line-voltage detection circuitry 120*b* of the embodiment illustrated in FIG. 5 includes an analog-to-digital converter (ADC) 510 and a binary-to-decimal decoder 520. The combination of ADC 510 and decoder 520 is configured to determine a difference between the reference voltage produced by generator 110 and the power voltage carried by power-supply line 30 and generate a signal 530 based on the determined difference.

Each OPAMP provides power to a zener diode through a current limiting resistor. The output of each zener is scaled down to deliver a voltage that corresponds to a particular LED current. These voltages are passed through diode, to prevent reverse voltage feed to the OPAMP output.

Figure 6:
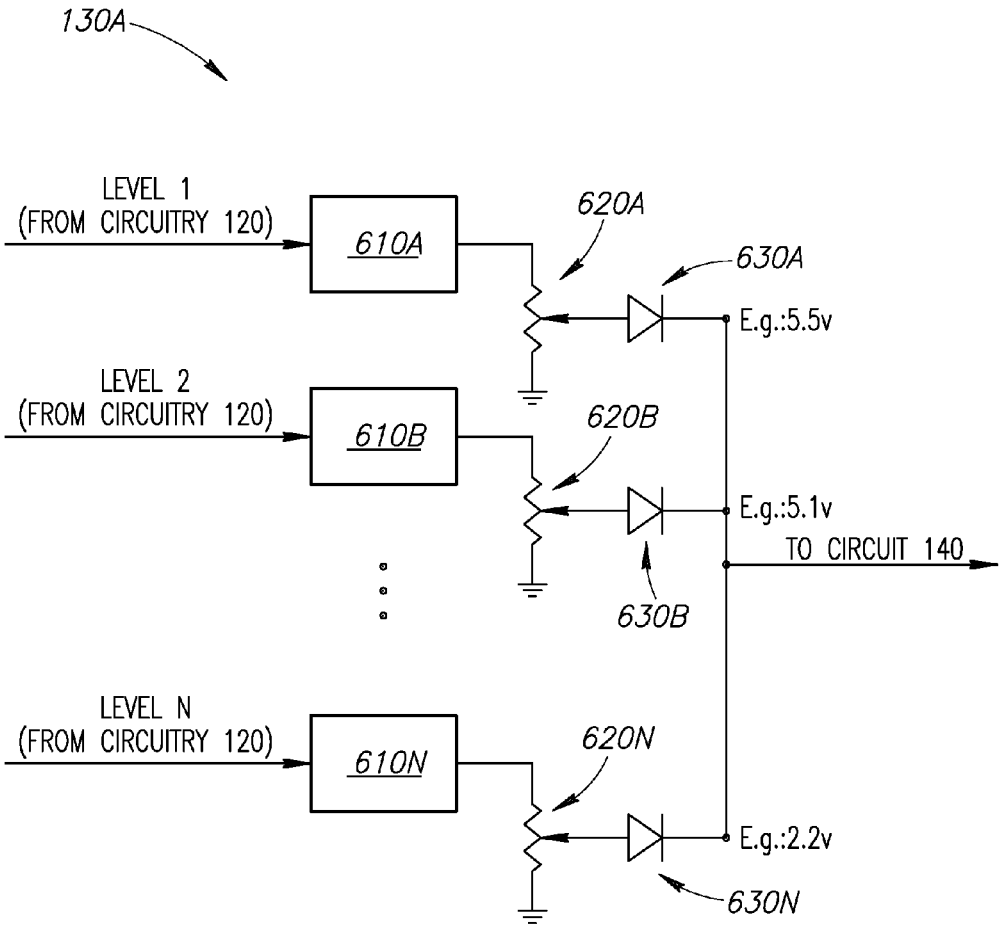
FIG. 6 illustrates converter circuitry according to an embodiment of the invention.

FIG. 6 illustrates converter circuitry 130*a* according to an embodiment of the invention. In the illustrated first embodiment, circuitry 120*a* or 120*b* provides its generated signal to a corresponding one of elements 610*a-n*, through a corresponding voltage divider 620*a-n*. Each of elements 610*a-n* may include a resistor and zener diode connected in series to ground. The output of each elements 610*a-n* is scaled down in this manner to deliver a second reference voltage that corresponds to a particular LED current. Any generated reference voltage is passed through a corresponding one of diodes 630*a-n*, to prevent reverse voltage feed to the output of circuitry 120*a* or 120*b*.

Figure 7:
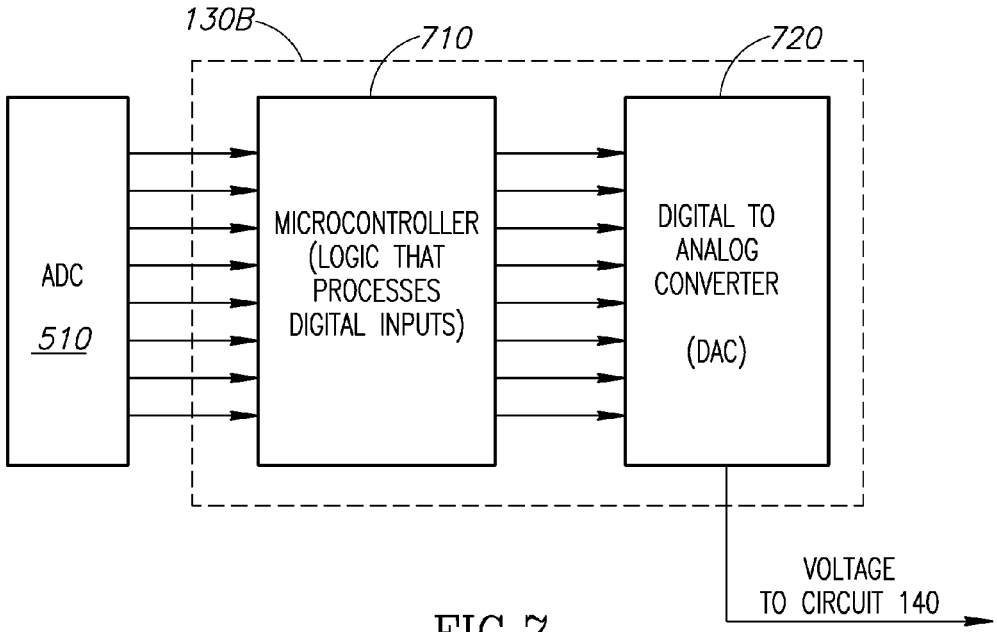
FIG. 7 illustrates converter circuitry according to a digital approach of an alternative embodiment of the invention.

FIG. 7 illustrates converter circuitry 130*b*, as indicated by dashed lines, according to a digital approach of an alternative embodiment of the invention. The illustrated second embodiment may be implemented in conjunction with the line-voltage detection circuitry 120*b* of FIG. 5 to achieve a fully digital solution. It should be noted that, if this fully digital solution is implemented, the binary-to-decimal decoder 520 illustrated in FIG. 5 is not necessary and may be omitted. As illustrated in FIG. 7, circuitry 130*b* includes a microcontroller 710 and a digital-to-analog converter (DAC) 720. The microcontroller 710 is configured to compensate for the exponential behavior of an LED, and linearize the output brightness to the input voltage based on mathematical manipulations through algorithms executed by the microcontroller. Consequently, the DAC 720 is able to generate an analog second reference voltage that corresponds to a particular LED current.

Figure 8:
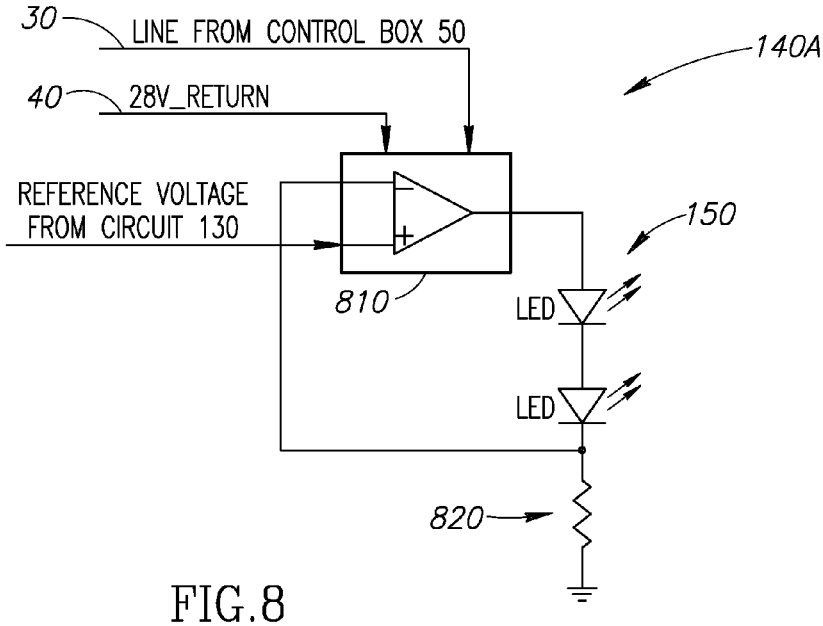
FIG. 8 illustrates a variable constant-current circuit according to an embodiment of the invention.

FIG. 8 illustrates a variable constant-current circuit 140*a* according to an embodiment of the invention. As earlier alluded to, a constant-current circuit maintains a constant current at the output, irrespective of the load. A variable constant current circuit, such as circuit 140*a*, includes functionality by which the amount of current to be maintained constantly at the output, irrespective of the load, may be controlled by an external input. The circuit 140*a* includes an operational amplifier 810 and a resistor 820. The operational amplifier 810 is configured to maintain a constant current by comparing the voltage developed across the resistor 820 (due to the current flowing through the LED string 150), and the second reference voltage from converter circuit 130.

Figure 9:
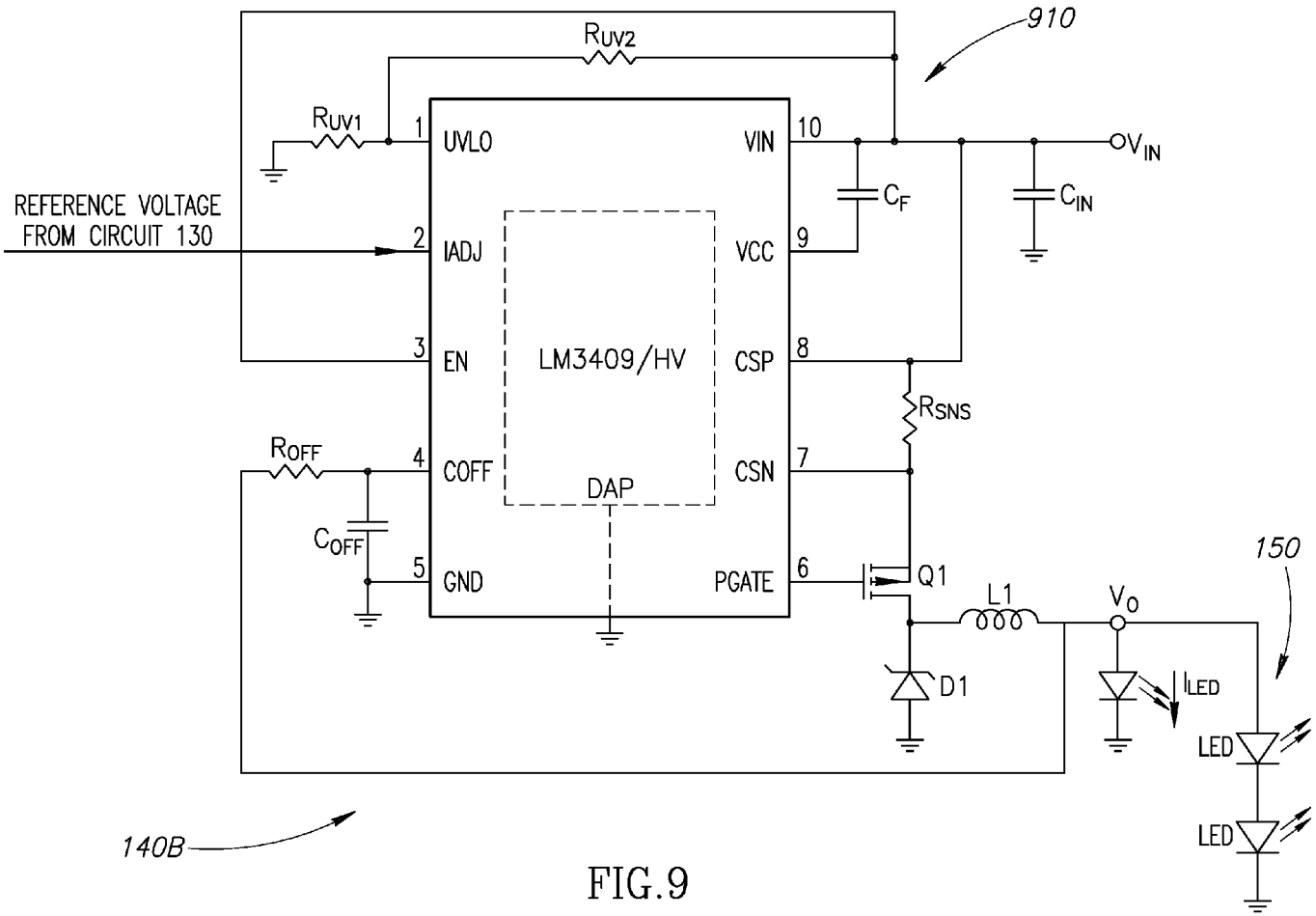
FIG. 9 illustrates a variable constant-current circuit according to an alternative embodiment of the invention.

FIG. 9 illustrates a variable constant-current circuit 140*b* according to an alternative embodiment of the invention. As illustrated, the second embodiment may include a switched-mode converter 910, such as the LM3409 from NSC having an $I_{ADJ}$ feature on pin 2, which can support an analog voltage output from the circuitry 130 described above. Switched-mode converter 910 maintains a constant current at its output and, consequently, string 150, the constant current level being set by the voltage at the $I_{ADJ}$ pin.

While the preferred embodiment of the invention has been illustrated and described, as noted above, many changes can be made without departing from the spirit and scope of the invention. It should be noted that line sensing intelligence internal to the lamp head 100 does not require, and may exclude, signals, other than the power voltage carried by power-supply line 30, to be sent to the lamp head regarding the brightness selected using switch box 50. Further, it should be noted that there are multiple configurations, other than and/or additional to those illustrated in and discussed with reference to FIGS. 8-9, that can provide a variable constant-current functionality. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A lamp head configured to be electrically coupled solely to a power-supply element and a return element, a power voltage carried by the power-supply element being regulated by a control element, the lamp comprising:

at least one LED configured to emit light; and a first circuit coupled to the at least one LED and configured to adjust the brightness of the light emitted by the at least one LED solely in response to adjustments made to the power voltage by the control element, wherein the first circuit comprises:

a second circuit coupled to the power-supply and return elements, the second circuit configured to generate a first reference voltage;

a third circuit coupled to the second circuit, the power-supply element and the return element, the third circuit configured to determine a difference between the first reference voltage and the power voltage and generate a first signal based on the determined difference; and a fourth circuit coupled to the third circuit, the fourth circuit configured to generate a second reference voltage based on the first signal.

2. The lamp head of claim 1, wherein the first circuit further comprises a fifth circuit coupled to the fourth circuit, the fifth circuit configured to maintain a constant level of current flow through the at least one LED, the constant level of current flow being a function of the second reference voltage.

3. The lamp head of claim 1, wherein the second circuit comprises a resistive element and a diode.

4. The lamp head of claim 1, wherein the third circuit comprises first and second operational amplifiers, wherein if the first reference voltage is less than the power voltage, then the first signal causes the at least one LED to emit light at a first brightness level, and if the first reference voltage is greater than the power voltage, then the first signal causes the at least one LED to emit light at a second brightness level lower than the first brightness level.

5. The lamp head of claim 1, wherein the third circuit comprises an analog-to-digital converter.

6. The lamp head of claim 1, wherein the third circuit comprises at least three window comparators configured to generate respective signals causing the at least one LED to emit light at at least three different brightness levels.

7. The lamp head of claim 1, wherein the fourth circuit comprises a resistive element and a zener diode.

8. The lamp head of claim 1, wherein the fourth circuit comprises a microcontroller and a digital-to-analog converter.

9. The lamp head of claim 2, wherein the fifth circuit comprises an operational amplifier.

10. The lamp head of claim 2, wherein the fifth circuit comprises a switched-mode converter.

11. A dimming circuit configured to be electrically coupled solely to a power-supply element, a return element and at least one LED configured to emit light, a power voltage carried by the power-supply element being regulated by a control element, the circuit comprising:

a first element coupled to the power-supply and return elements, the first element configured to generate a first reference voltage;

a second element coupled to the first element, the power-supply element and the return element, the second element configured to determine a difference between the first reference voltage and the power voltage and generate a first signal based on the determined difference;

a third element coupled to the second element, the third element configured to generate a second reference voltage based on the first signal; and a fourth element coupled to the third element, the fourth element configured to maintain a constant level of current flow through the at least one LED, the constant level of current flow being a function of the second reference voltage, wherein the brightness of the light emitted by the at least one LED is adjusted solely in response to adjustments made to the power voltage by the control element.

12. The dimming circuit of claim 11, wherein the first element comprises a resistive element and a diode.

13. The dimming circuit of claim 11, wherein the second element comprises first and second operational amplifiers, wherein if the first reference voltage is less than the power voltage, then the first signal causes the at least one LED to emit light at a first brightness level, and if the first reference voltage is greater than the power voltage, then the first signal causes the at least one LED to emit light at a second brightness level lower than the first brightness level.

14. The dimming circuit of claim 11, wherein the third element comprises a resistive element and a zener diode.

15. The dimming circuit of claim 11, wherein the fourth element comprises an operational amplifier.

16. A lamp head configured to be electrically coupled solely to a power-supply element and a return element, a power voltage carried by the power-supply element being regulated by a control element, the lamp head comprising:

at least one LED configured to emit light; and a first circuit coupled to the at least one LED and configured to adjust the brightness of the light emitted by the at least one LED solely in response to adjustments made to the power voltage by the control element, wherein the first circuit comprises:

a second circuit coupled to the power-supply and return elements, the second circuit configured to generate a first reference voltage; and a third circuit coupled to the second circuit, the power-supply element and the return element, the third circuit configured to determine a difference between the first reference voltage and the power voltage and generate a first signal based on the determined difference, wherein the third circuit comprises first and second operational amplifiers, wherein if the first reference voltage is less than the power voltage, then the first signal causes the at least one LED to emit light at a first brightness level, and if the first reference voltage is greater than the power voltage, then the first signal causes the at least one LED to emit light at a second brightness level lower than the first brightness level.

17. The lamp head of claim 16, wherein the third circuit comprises an analog-to-digital converter.

18. The lamp head of claim 16, wherein the third circuit comprises at least three window comparators configured to generate respective signals causing the at least one LED to emit light at at least three different brightness levels.

* * * * *